US009141080B2

(12) United States Patent
Mitorida et al.

(10) Patent No.: US 9,141,080 B2
(45) Date of Patent: Sep. 22, 2015

(54) DRAWER MEMBER HAVING IMAGE FIXING UNIT, AND IMAGE FORMING APPARATUS HAVING SAME

(71) Applicant: FUJI XEROX CO., LTD., Tokyo (JP)

(72) Inventors: Shinya Mitorida, Kanagawa (JP); Taichi Fuchu, Kanagawa (JP); Hirotake Eguchi, Kanagawa (JP); Satoru Nishikawa, Kanagawa (JP); Akira Numazaki, Kanagawa (JP); Satoshi Takada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/291,868

(22) Filed: May 30, 2014

(65) Prior Publication Data

US 2015/0098723 A1 Apr. 9, 2015

(30) Foreign Application Priority Data

Oct. 7, 2013 (JP) ..... 2013-210368

(51) Int. Cl.
*G03G 15/20* (2006.01)
*G03G 21/20* (2006.01)
*G03G 21/16* (2006.01)

(52) U.S. Cl.
CPC ..... *G03G 21/1685* (2013.01)

(58) Field of Classification Search
CPC ..... G03G 21/206; G03G 2221/1645; G03G 21/20; G03G 15/2021
USPC ..... 399/92, 94
See application file for complete search history.

(56) References Cited

U.S. PATENT DOCUMENTS

| | | | | |
|---|---|---|---|---|
| 8,170,432 | B2 * | 5/2012 | Takeuchi | 399/49 |
| 8,725,024 | B2 * | 5/2014 | Tashiro | 399/92 |
| 2012/0251157 | A1 * | 10/2012 | Tanda | 399/94 |
| 2013/0177332 | A1 * | 7/2013 | Saito | 399/92 |
| 2014/0341607 | A1 * | 11/2014 | Nakano et al. | 399/92 |

FOREIGN PATENT DOCUMENTS

JP A-2005-258116 9/2005

* cited by examiner

*Primary Examiner* — Francis Gray
(74) *Attorney, Agent, or Firm* — Oliff PLC

(57) ABSTRACT

A drawer member that is capable of being drawn out from an image forming apparatus body and that includes a fixing unit that heats and fixes an image onto a recording medium, a first flow path that is formed around the fixing unit and that causes air that is heated by heat, which is discharged from the fixing unit, to circulate, and a second flow path that is formed adjacent to the first flow path on a side opposite to the fixing unit and in which air having a temperature lower than a temperature of air, which circulates in the first flow path, circulates.

2 Claims, 9 Drawing Sheets

DRAWER MEMBER HAVING IMAGE FIXING UNIT, AND IMAGE FORMING APPARATUS HAVING SAME

CROSS-REFERENCE TO RELATED APPLICATIONS

This application is based on and claims priority under 35 USC 119 from Japanese Patent Application No. 2013-210368 filed Oct. 7, 2013.

BACKGROUND

Technical Field

The present invention relates to a drawer member and an image forming apparatus.

SUMMARY

According to an aspect of the invention, there is provided a drawer member that is capable of being drawn out from an image forming apparatus body, the drawer member including a fixing unit that heats and fixes an image onto a recording medium, a first flow path that is formed around the fixing unit and that causes air that is heated by heat, which is discharged from the fixing unit, to circulate, and a second flow path that is formed adjacent to the first flow path on a side opposite to the fixing unit and in which air having a temperature lower than a temperature of air, which circulates in the first flow path, circulates.

BRIEF DESCRIPTION OF THE DRAWINGS

Exemplary embodiments of the present invention will be described in detail based on the following figures, wherein.

DETAILED DESCRIPTION

An example of an exemplary embodiment of the present invention will be described below with reference to the drawings.

(Configuration of Image Forming Apparatus 10)

Figure 1:
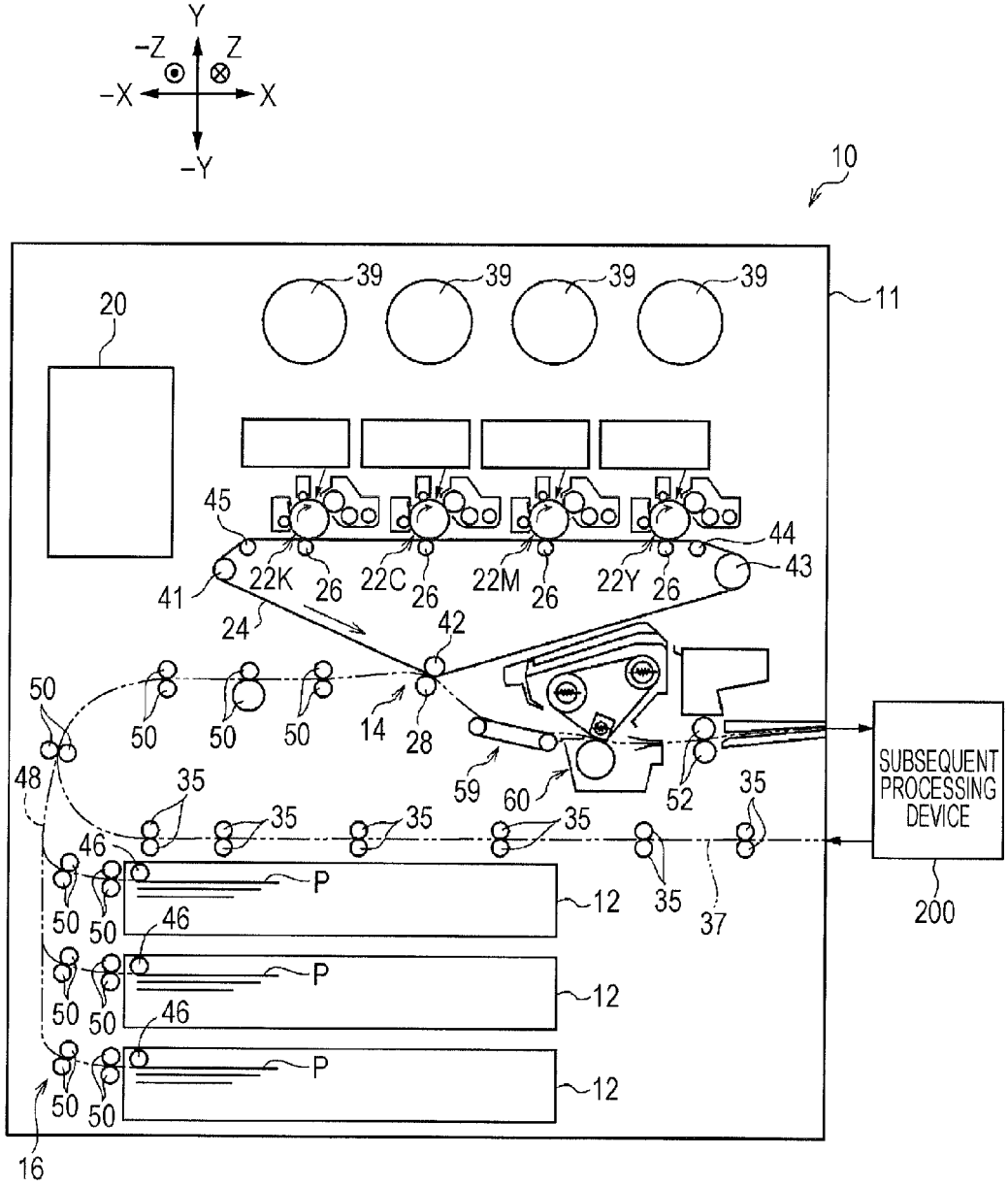
FIG. 1 is a schematic diagram illustrating the configuration of an image forming apparatus according to an exemplary embodiment.

First, the configuration of an image forming apparatus 10 according to the exemplary embodiment will be described. FIG. 1 is a schematic diagram illustrating the configuration of the image forming apparatus 10. Note that the X direction, the −X direction, the Y direction, the −Y direction, the Z direction, and the −Z direction that will be used in the following description are the directions of arrows illustrated in the drawings. In addition, in the drawings, a symbol having "×" in "○" denotes an arrow extending from the proximal side toward the distal side as viewed in the drawings, and a symbol having "·" in "○" denotes an arrow extending from the distal side toward the proximal side as viewed in the drawings.

As illustrated in FIG. 1, the image forming apparatus 10 includes an image forming apparatus body 11 (a housing) in which components are accommodated. Accommodating units 12 in which recording media P such as sheets are to be accommodated, an image forming section 14 that forms an image on one of the recording media P, a transport section 16 that transports one of the recording media P from one of the accommodating units 12 to the image forming section 14, and a controller 20 that controls the operation of each unit of the image forming apparatus 10 are disposed in the image forming apparatus body 11.

The image forming section 14 includes image forming units 22Y, 22M, 22C, and 22K (hereinafter referred to as image forming units 22Y to 22K) that form toner images of yellow (Y), magenta (M), cyan (C), and black (K) colors, an intermediate transfer belt 24 to which toner images that have been formed by the image forming units 22Y to 22K are to be transferred, first transfer rollers 26 that transfer the toner images, which have been formed by the image forming units 22Y to 22K, onto the intermediate transfer belt 24, and a second transfer roller 28 that transfers the toner images, which have been transferred to the intermediate transfer belt 24 by the first transfer rollers 26, onto one of the recording media P from the intermediate transfer belt 24. Note that the image forming section 14 is not limited to have the above-described configuration and may have a different configuration as long as the image forming section 14 forms an image on one of the recording media P.

Figure 2:
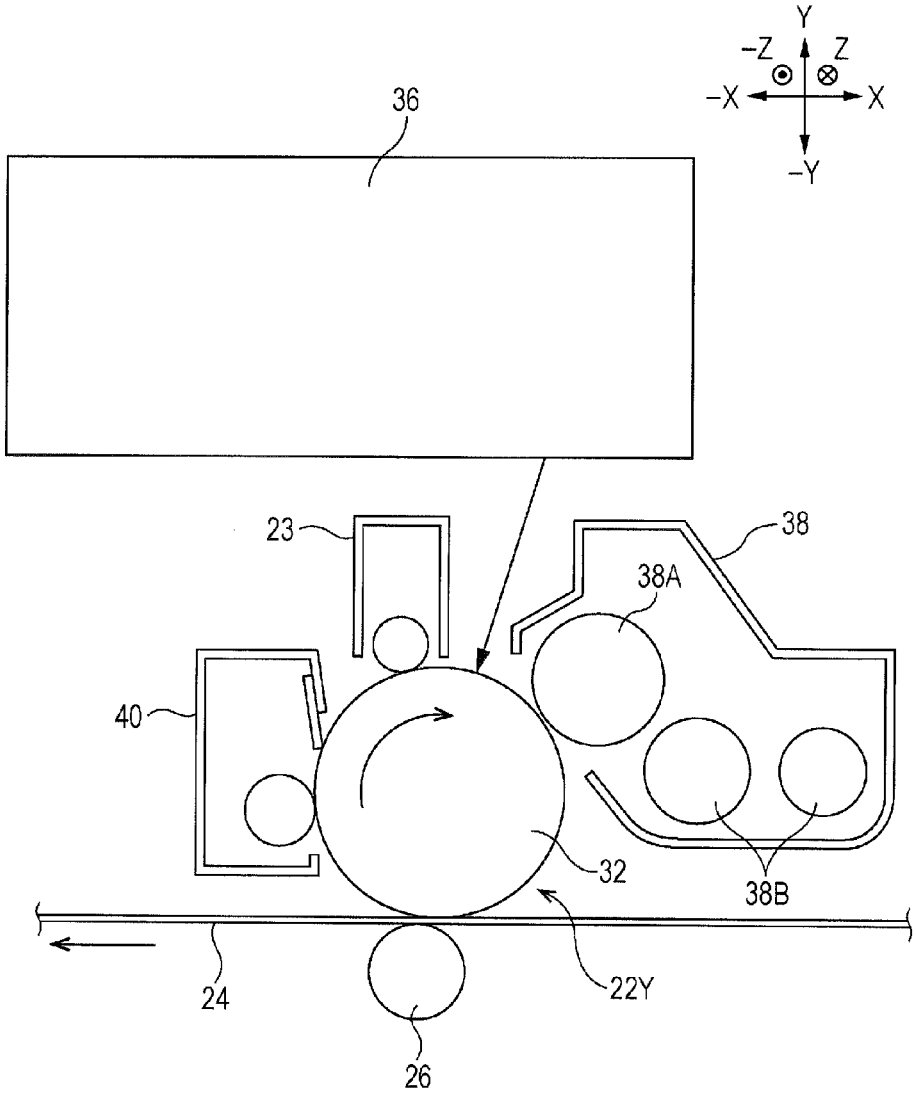
FIG. 2 is a schematic diagram illustrating the configuration of an image forming unit according to the exemplary embodiment.

The image forming units 22Y to 22K are arranged next to each other in the X direction and adjacent to (above) the intermediate transfer belt 24 in the Y direction. As illustrated in FIG. 2, each of the image forming units 22Y to 22K includes a photoconductor 32 that rotates in one direction (e.g., a clockwise direction in FIG. 2). Note that since the image forming units 22Y to 22K have the same configuration, FIG. 2 illustrates the configuration of the image forming unit 22Y as a representative example of the image forming units 22Y to 22K.

Around the periphery of each of the photoconductors 32, a charging device 23 that charges the photoconductor 32, an exposure device 36 that exposes the photoconductor 32, which has been charged by the charging device 23, to light and forms an electrostatic latent image on the photoconductor 32, a developing device 38 that develops the electrostatic latent image, which has been formed on the photoconductor 32 by the exposure device 36, and forms a toner image, and a removal device 40 that removes toner that remains on the photoconductor 32 by making contact with the photoconductor 32 are disposed in this order starting from an upstream side in a rotation direction of the photoconductor 32.

Each of the exposure devices 36 is configured to form an electrostatic latent image on the basis of an image signal that is sent from the controller 20 (see FIG. 1). An example of such an image signal, which is sent from the controller 20, is an image signal that is acquired by the controller 20 from an external apparatus.

Each of the developing devices 38 includes a developer supply body 38A that supplies a developer to the photoconductor 32 and transport members 38B that transport the developer, which is to be supplied to the developer supply body 38A, while stirring the developer.

As illustrated in FIG. 1, toner containing sections 39 that contain toners that are to be supplied to the developing devices 38 of the image forming units 22Y to 22K are disposed above the exposure devices 36.

The intermediate transfer belt 24 is formed into an annular shape and arranged adjacent to (below) the image forming units 22Y to 22K in the −Y direction. Winding rollers 41, 42, 43, 44, and 45 around which the intermediate transfer belt 24 is wound are disposed on the inner periphery side of the intermediate transfer belt 24. As an example, the intermediate transfer belt 24 moves circularly (rotates) in one direction (e.g., a counterclockwise direction in FIG. 1) while being in contact with the photoconductors 32 as a result of the winding roller 43 being driven so as to rotate. Note that the winding roller 42 serves as a counter roller that faces the second transfer roller 28. A removal device 49 (see FIG. 4) that removes a substance that is attached to the intermediate transfer belt 24 is disposed below the winding roller 43.

Each of the first transfer rollers 26 faces a corresponding one of the photoconductors 32 with the intermediate transfer belt 24 interposed therebetween. The position between each of the first transfer rollers 26 and the corresponding photoconductor 32 is a first transfer position at which a toner image that has been formed on the photoconductor 32 is transferred onto the intermediate transfer belt 24.

The second transfer roller 28 faces the winding roller 42 with the intermediate transfer belt 24 interposed therebetween. The position between the second transfer roller 28 and the winding roller 42 is a second transfer position at which a toner image that has been transferred to the intermediate transfer belt 24 is transferred onto one of the recording media P.

The transport section 16 includes delivery rollers 46 each of which sends out one of the recording media P that is accommodated in one of the accommodating units 12, a transport path 48 along which one of the recording media P that has been sent out by one of the delivery rollers 46 is to be transported, and transport rollers 50 that are disposed along the transport path 48 and that transport one of the recording media P that has been sent out by one of the delivery rollers 46 to the second transfer position.

Figure 4:
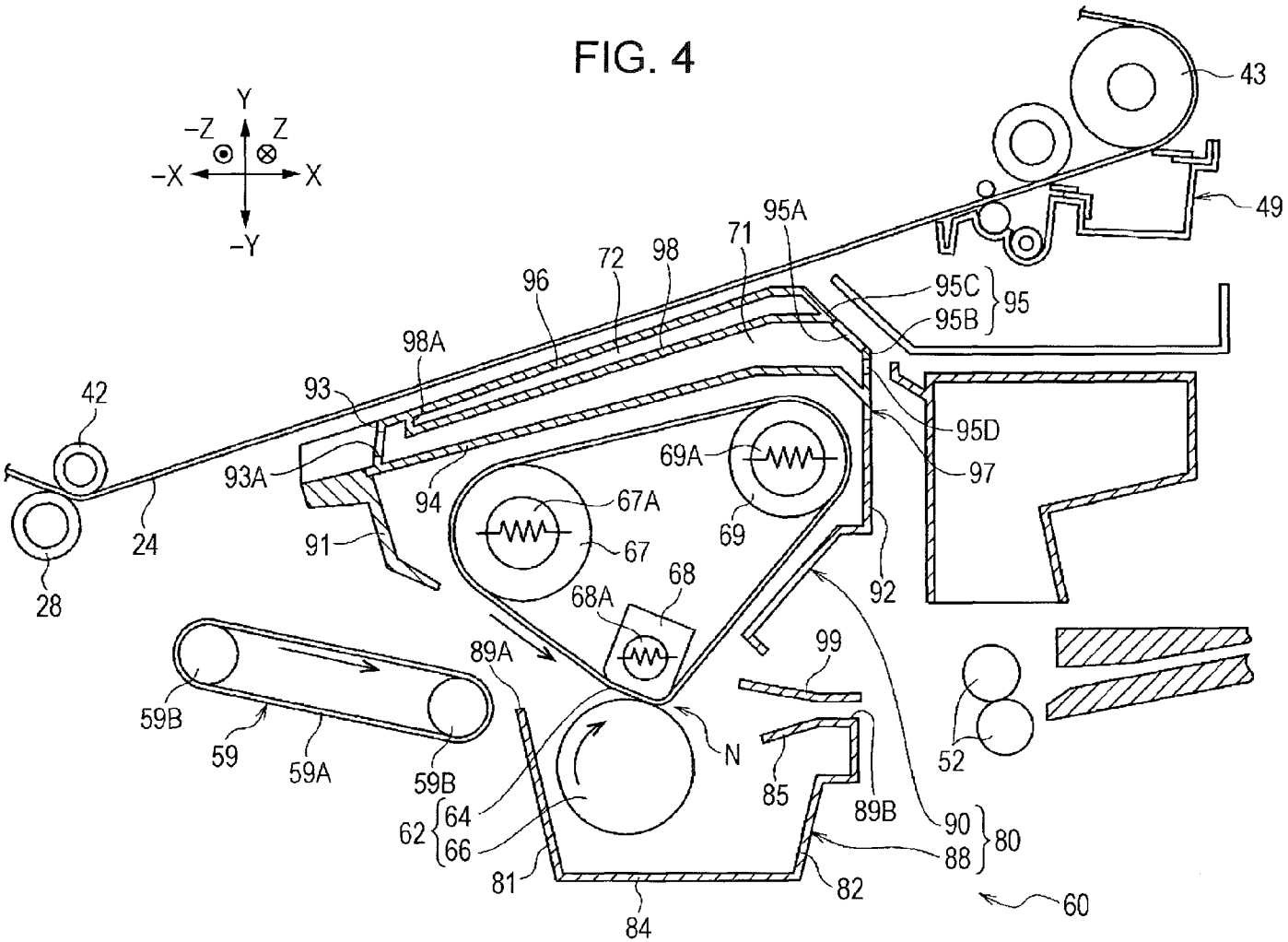
FIG. 4 is a sectional front view illustrating the configuration of a fixing device according to the exemplary embodiment.

A transport member 59 that transports one of the recording media P to which a toner image has been transferred by the second transfer roller 28 is disposed on a downstream side of the second transfer position in a transport direction. As illustrated in FIG. 4, the transport member 59 includes an annular (endless) transport belt 59A and a pair of rollers 59B around which the transport belt 59A is wound. As a result of at least one of the pair of rollers 59B being driven so as to rotate in a state where one of the recording media P is held on the outer peripheral surface of the transport belt 59A, the recording medium P is transported to a fixing device 60, which will be described below. Note that, as an example, the transport belt 59A is configured to hold one of the recording media P as a result of the recording medium P being drawn in through intake holes that are formed in the transport belt 59A.

The fixing device 60 that fixes a toner image, which has been transferred to one of the recording media P by the second transfer roller 28, onto the recording medium P is disposed on a downstream side of the transport member 59 in the transport direction.

A drawer member 100 (see FIG. 3) that includes the fixing device 60 and the transport member 59 is disposed in such a manner as to be capable of being drawn out of the image forming apparatus body 11. The specific configurations of the drawer member 100 and the fixing device 60 will be described later.

In addition, as illustrated in FIG. 1, ejection rollers 52 that eject one of the recording media P, on which a toner image has been fixed, from the image forming apparatus body 11 to a subsequent processing device 200 are disposed on a downstream side of the fixing device 60 in the transport direction. Note that the subsequent processing device 200 includes, for example, a cooling unit (not illustrated) that cools one of the recording media P, a correction unit (not illustrated) that corrects the curvature of the recording medium P, an inspection unit (not illustrated) that inspects an image that has been formed on the recording medium P.

In addition, a transport path 37 that is used for transporting one of the recording media P that has a surface to which a toner image has been fixed back to the second transfer position is disposed at a position that is below the fixing device 60 and above the accommodating units 12. One of the recording media P that has been ejected to the subsequent processing device 200 by the ejection rollers 52 is to be reversed in the subsequent processing device 200 and sent to the transport path 37. The recording medium P that has been sent to the transport path 37 is transported to the second transfer position by pairs of transport rollers 35 that are disposed along the transport path 37.

(Image Forming Operation)

An image forming operation in which an image is formed on one of the recording media P in the image forming apparatus 10 according to the exemplary embodiment will now be described.

In the image forming apparatus 10 according to the exemplary embodiment, one of the recording media P that has been sent out from one of the accommodating units 12 by the corresponding delivery roller 46 is sent into the second transfer position by the transport rollers 50.

On the other hand, in each of the image forming units 22Y to 22K, the photoconductor 32 that has been charged by the charging device 23 is exposed to light by the exposure device 36, and an electrostatic latent image is formed on the photoconductor 32. The electrostatic latent image is developed by the developing device 38, and a toner image is formed on the photoconductor 32. Toner images of different colors that have been formed by the image forming units 22Y to 22K are superposed with one another on the intermediate transfer belt 24 at the first transfer position, so that a color image is formed. Then, the color image that has been formed on the intermediate transfer belt 24 is transferred onto the recording medium P at the second transfer position.

The recording medium P to which the toner image has been transferred is transported to the fixing device 60 by the transport member 59, and the toner image, which has been transferred to the recording medium P, is fixed onto the recording medium P by the fixing device 60. The recording medium P to which the toner image has been fixed is ejected from the image forming apparatus body 11 to the subsequent processing device 200 by the ejection rollers 52. A series of image forming operations are performed in the manner described above.

(Configuration of Drawer Member 100)

Figure 3:
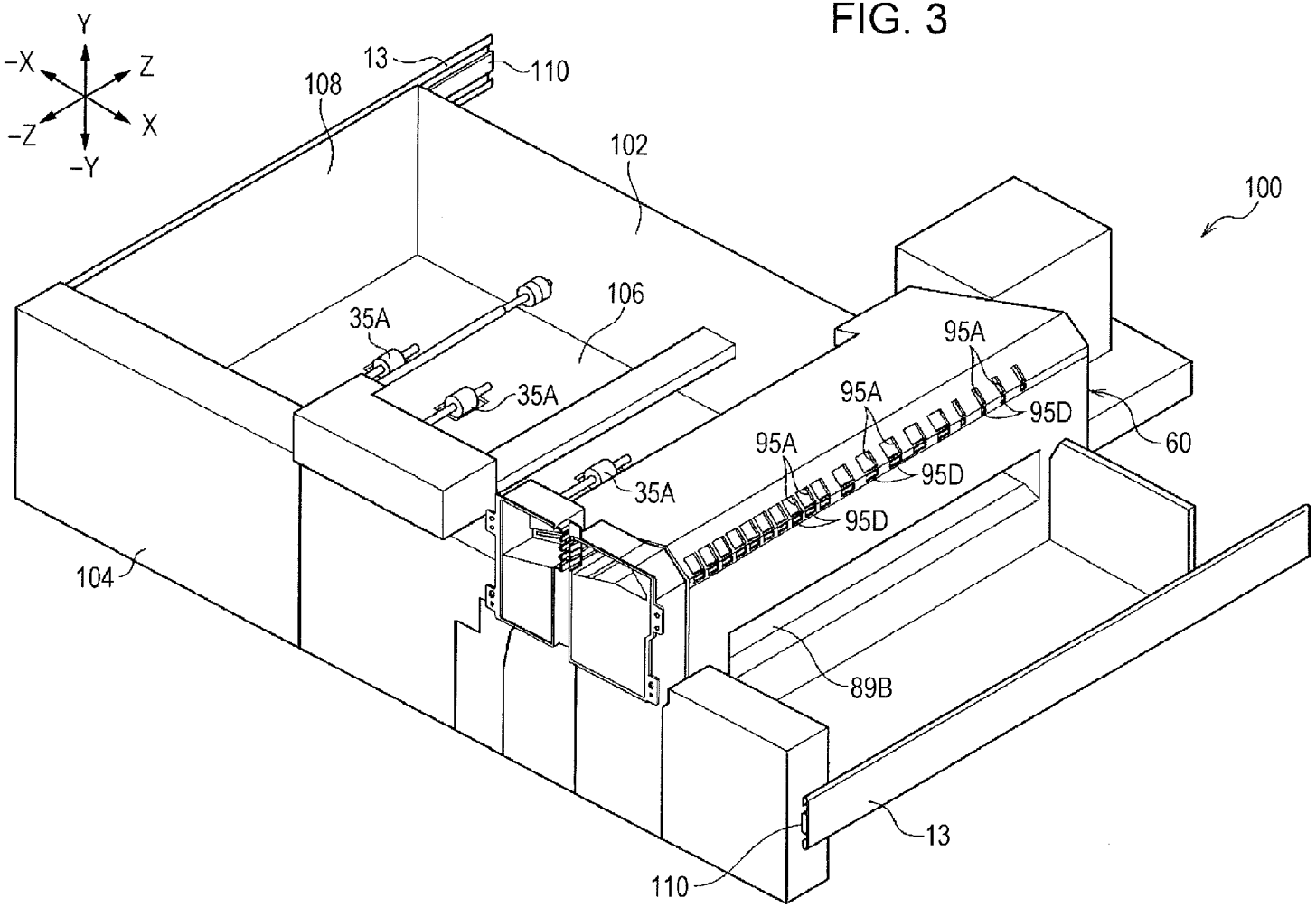
FIG. 3 is a perspective view illustrating the configuration of a drawer member according to the exemplary embodiment.

The configuration of the drawer member 100 will now be described. FIG. 3 is a perspective view illustrating the configuration of the drawer member 100.

As illustrated in FIG. 3, the drawer member 100 includes the fixing device 60. In addition, the drawer member 100 includes a frame 102 that is disposed on the Z direction side, a frame 104 that is disposed on the −Z direction side, a frame 108 that is disposed on the −X direction side, and a bottom plate 106 that is disposed on the −Y direction side (the lower side).

The bottom plate 106 forms a transport path surface at the top of the above-described transport path 37 (see FIG. 1). Upper rollers 35A of the pairs of transport rollers 35 are disposed on the bottom plate 106.

A pair of guided members 110 that are guided by a pair of guiding members 13 (rail members) that are mounted on the image forming apparatus body 11 (see FIG. 1) are each disposed on an end portion of the drawer member 100 facing the X direction and an end portion of the drawer member 100 facing the −X direction (the frame 108). The guided members 110 are guided by the guiding members 13 in the −Z direction, so that the drawer member 100 is drawn out from the image forming apparatus body 11 in the −Z direction. The drawer member 100 is drawn out from the image forming apparatus body 11, so that the transport path 37 (see FIG. 1) is open, and a process of removing one of the recording media P that has become jammed in the transport path 37 may be performed. Note that the drawer member 100 is configured so as to be capable of being drawn out from the image forming apparatus body 11 without being separated from the image forming apparatus body 11.

In a state where the drawer member 100 has been drawn out from the image forming apparatus body 11, the guided members 110 are guided by the guiding members 13 in the Z direction, so that the drawer member 100 may be accommodated in the image forming apparatus body 11.

(Configuration Fixing Device 60)

The configuration of the fixing device 60 according to the exemplary embodiment will now be described.

As illustrated in FIG. 4, the fixing device 60 includes a housing 80 and a fixing unit 62 that is disposed in the housing 80 and that heats and fixes a toner image (an example of an image) onto one of the recording media P. The fixing device 60 is disposed in the drawer member 100, and the housing 80 that includes a first flow path 71 and a second flow path 72, each of which will be described later, and the fixing unit 62 are to be capable of being integrally drawn out from the image forming apparatus body 11 (see FIG. 1).

The fixing unit 62 includes a fixing belt 64 serving as a heating member and a pressure roller 66 serving as pressure member. As an example, the pressure roller 66 is formed of a columnar aluminum roller body (not illustrated) having an outer circumferential surface that is coated with an elastic body layer made of silicone rubber. A release layer made of a fluorocarbon resin or the like is formed on the outer peripheral surface of the elastic body layer. The pressure roller 66 is driven by a driving unit (not illustrated) so as to rotate in one direction (a clockwise direction in FIG. 4).

As an example, the fixing belt 64 is formed of a base member made of a polyamide that has a surface, which is coated with a fluorocarbon resin, and the fixing belt 64 has an annular shape (an endless loop shape) that is open in the Z direction and the −Z direction. In addition, the fixing belt 64 is wound around a pad member 68, a first heating roller 69, and a second heating roller 67. The fixing belt 64 is driven by the pressure roller 66 and moves circularly (rotates) in one direction (a counterclockwise direction in FIG. 4). Note that the fixing belt 64 may move circularly (rotate) in the one direction (the counterclockwise direction in FIG. 4) as a result of at least one of the first heating roller 69 and the second heating roller 67 being driven so as to rotate.

The pad member 68 is fixed to the housing 80 on the inner periphery side of the fixing belt 64 in such a manner that the fixing belt 64, which moves circularly, slides while being in contact with a surface of the pad member 68 on the −Y direction side (a bottom surface of the pad member 68). The pad member 68 receives a pressure (nip) load from the pressure roller 66, so that a nip part N is defined between the fixing belt 64 and the pressure roller 66. A heating source such as a halogen heater 68A is disposed inside the pad member 68.

The first heating roller 69 is positioned downstream of the pad member 68 in the direction in which the fixing belt 64 circulates. The first heating roller 69 is formed in a cylindrical shape, and a heating source such as a halogen heater 69A is disposed on the inner periphery side of the first heating roller 69. The first heating roller 69 heats the fixing belt 64 by the heating source.

The second heating roller 67 is positioned downstream of the first heating roller 69 in the direction in which the fixing belt 64 circulates. The second heating roller 67 is formed in a cylindrical shape, and a heating source such as a halogen heater 67A is disposed on the inner periphery side of the second heating roller 67. The second heating roller 67 heats the fixing belt 64 by the heating source. Note that at least one of the first heating roller 69, the second heating roller 67, and the pad member 68 may be provided with such a heating source.

The housing 80 includes an upper housing 90 that surrounds an upper portion and side portions of the fixing belt 64 and a lower housing 88 that surrounds a lower portion and side portions of the pressure roller 66. In an area between the upper housing 90 and the lower housing 88, an entry port 89A into which one of the recording media P is fed is formed on the −X direction side, and a discharge port 89B from which the recording medium P is discharged is formed on the X direction side. In other words, one of the recording media P is fed into the entry port 89A from the −X direction side and is discharged from the discharge port 89B toward the X direction side.

The lower housing 88 includes a first side wall 81 that is disposed on the side to which one of the recording media P advances (the −X direction side), a second side wall 82 that is disposed on the side from which the recording medium P is to be discharged (the X direction side), and a bottom wall 84 that is disposed on the −Y direction side (the lower side).

More specifically, the first side wall 81 is vertically arranged in the Y direction on an end of the bottom wall 84 on the −X direction side. The second side wall 82 is vertically arranged in the Y direction on an end of the bottom wall 84 on the X direction side. A guiding portion 85 (a guide) is formed so as to extend in the −X direction on an end of the second side wall 82 on the Y direction side (an upper end of the second side wall 82). The guiding portion 85 has a function of guiding one of the recording media P that is to be discharged from the nip part N, which is defined between the fixing belt 64 and the pressure roller 66, to the ejection rollers 52.

The upper housing 90 includes a top wall 94 that is disposed on the Y direction side (the upper side) so as to face the fixing belt 64, a first side wall 91 that is disposed on the side to which one of the recording media P advances (the −X direction side), a second side wall 92 that is disposed on the side from which the recording medium P is to be discharged (the X direction side), and a guiding portion 99 (a guide) that is disposed adjacent to (below) the second side wall 92 in the −Y direction.

More specifically, the first side wall 91 extends in the −Y direction (downward) from an end of the top wall 94 on the −X direction side. A portion of the first side wall 91 on the −Y direction side (a bottom portion of the first side wall 91) is inclined in the X direction, and the inclination of the bottom portion increases with increasing distance from the end of the top wall 94 on the −X direction side in the −Y direction (the downward direction). The second side wall 92 extends in the −Y direction (downward) from an end of the top wall 94 on the X direction side. A portion of the second side wall 92 on the −Y direction side (a bottom portion of the second side wall 92) is inclined to the −X direction, and the inclination of the bottom portion increases with increasing distance from the end of the top wall 94 on the X direction side in the −Y direction (the downward direction). The guiding portion 99 has a function of guiding, together with the guiding portion 85, one of the recording media P that is to be discharged from the nip part N, which is defined between the fixing belt 64 and the pressure roller 66, to the ejection rollers 52.

In addition, the upper housing 90 includes an outer wall 96 that is disposed adjacent to (above) the top wall 94 in the Y direction, a first connecting wall 93 (a side wall) that connects the end of the top wall 94 on the −X direction side and an end of the outer wall 96 on the −X direction side, a second connecting wall 95 (a side wall) that connects the end of the top wall 94 on the X direction side and an end of the outer wall 96 on the X direction side, and a partition wall 98 that partitions a space between the top wall 94 and the outer wall 96 into an upper-layer space and a lower-layer space.

Figure 5:
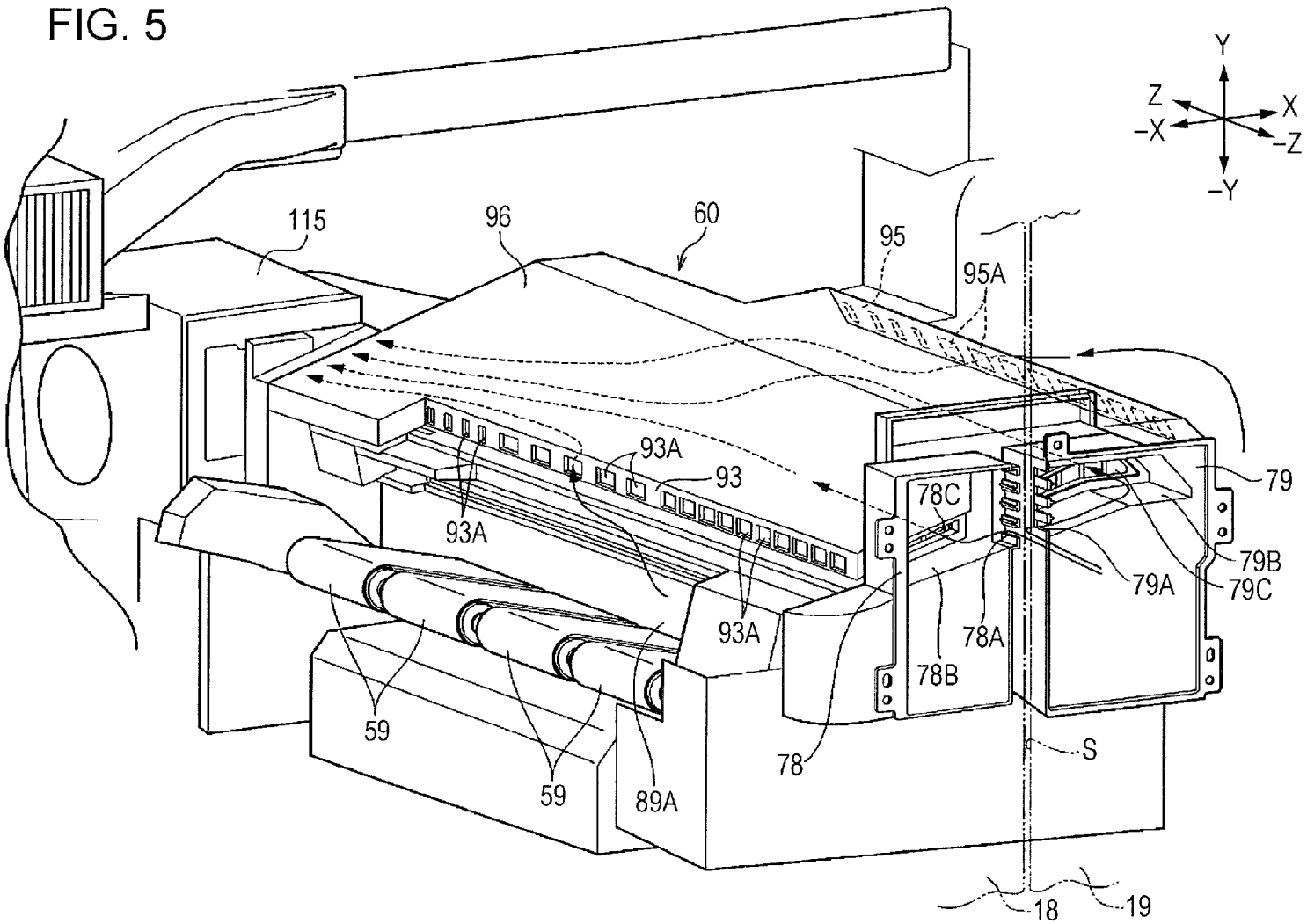
FIG. 5 is a perspective view illustrating the configuration of the fixing device according to the exemplary embodiment.
Figure 6:
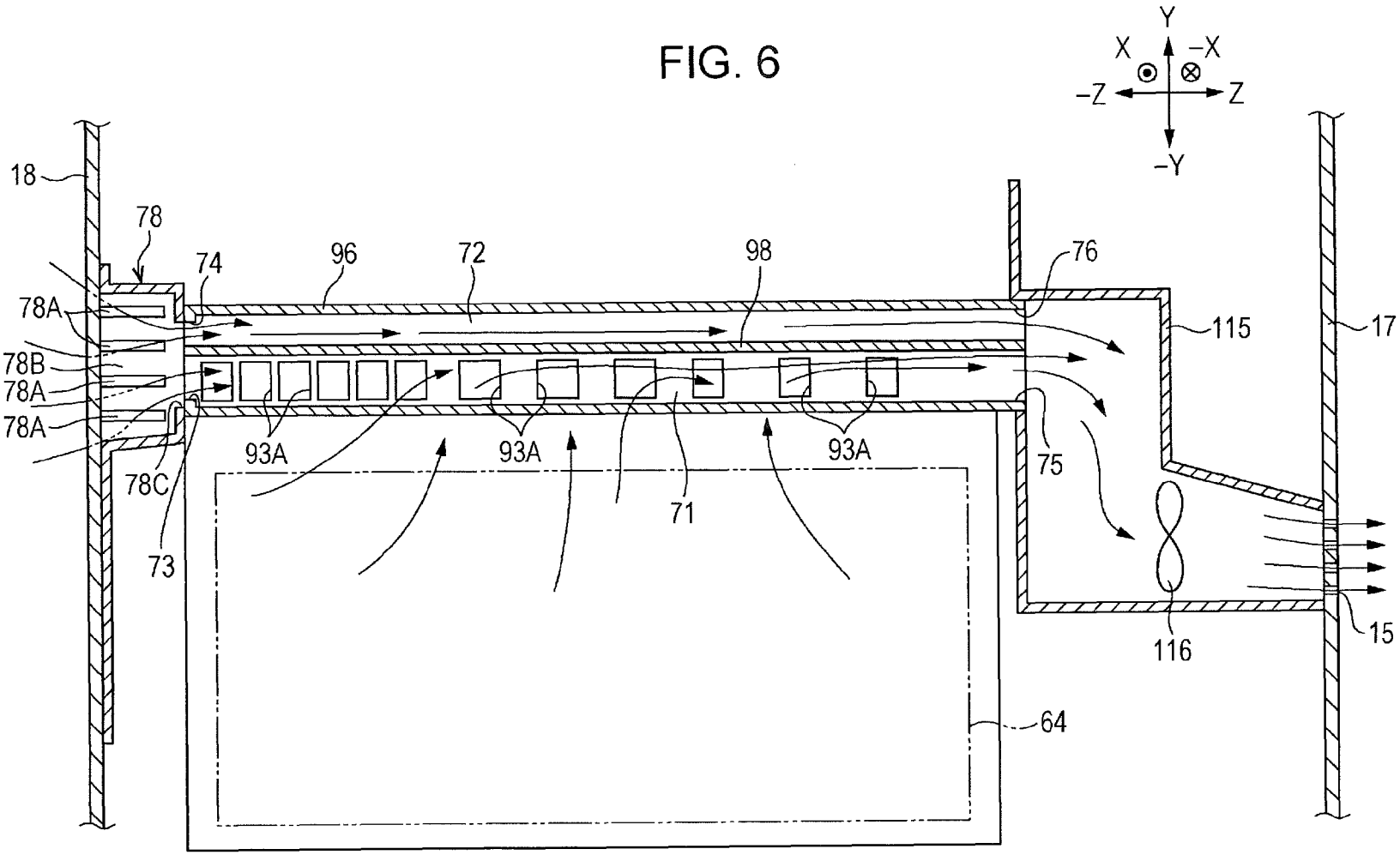
FIG. 6 is a sectional side view illustrating the configurations of flow paths according to the exemplary embodiment.

The first connecting wall 93 is vertically arranged in the Y direction (upward) on the end of the top wall 94 on the −X direction side. Inlet ports 93A into which air (hereinafter referred to as hot air) that is heated by the heat that is discharged from the fixing unit 62 (specifically, the fixing belt 64) flows are formed in the first connecting wall 93. As illustrated in FIG. 5 and FIG. 6, the inlet ports 93A are formed along the Z direction. The size of each of the inlet ports 93A and the arrangement interval of the inlet ports 93A are set in such a manner that the density of openings realized by the inlet ports 93A decreases in a stepwise manner toward the Z direction.

As illustrated in FIG. 4, the second connecting wall 95 includes an upright portion 95B that stands upright in the Y direction (upward) at the end of the top wall 94 on the X direction side and an inclined portion 95C that is inclined in the −X direction. The inclination of the inclined portion 95C increases with increasing distance from an end of the upright portion 95B on the Y direction side (an upper end of the upright portion 95B) in the Y direction.

An end of the inclined portion 95C on the Y direction side (an upper end of the inclined portion 95C) is connected to the end of the outer wall 96 on the X direction side, and a portion of the inclined portion 95C at a position partway along the inclined portion 95C in the Y direction is connected to an end of the partition wall 98 on the X direction side. Inlet ports 95A into which the hot air from the fixing unit 62 (specifically, the fixing belt 64) flows are formed in a portion of the inclined portion 95C that is adjacent to (below) the partition wall 98 in the −Y direction. In addition, inlet ports 95D into which the hot air from the fixing unit 62 (specifically, the fixing belt 64) flows are formed in the upright portion 95B. As illustrated in FIG. 3, the inlet ports 95A and 95D are formed along the Z direction. The size of each of the inlet ports 95A and 95D and the arrangement interval of the inlet ports 95A and 95D are set in such a manner that the density of openings realized by the inlet ports 95A and 95D decreases in a stepwise manner toward the Z direction.

As illustrated in FIG. 4, an end of the partition wall 98 on the −X direction side is connected to the outer wall 96 via a protruding portion 98A that protrudes upward. With this configuration, the partition wall 98 partitions the space between the top wall 94 and the outer wall 96 into the first flow path 71 that is formed of an upper-layer space and the second flow path 72 that is formed of a lower-layer space. In other words, the first flow path 71 is surrounded by the top wall 94, the partition wall 98, the first connecting wall 93, the upright portion 95B of the second connecting wall 95, and a portion of the inclined portion 95C of the second connecting wall 95 (the portion of the inclined portion 95C, which is below the partition wall 98 in the −Y direction). The second flow path 72 is surrounded by the outer wall 96, the partition wall 98, and a portion of the inclined portion 95C of the second connecting wall 95 (a portion of the inclined portion 95C that is above the partition wall 98 in the Y direction). In other words, the second flow path 72 is formed adjacent to the first flow path 71 on the side opposite to that on which the fixing unit 62 is disposed.

The hot air from the fixing unit 62 flows into the first flow path 71 through the inlet ports 93A, 95A, and 95D. The second flow path 72 is a space that is separated from the first flow path 71, and the hot air that has flowed in from the inlet ports 93A, 95A, and 95D will not flow into the second flow path 72.

Figure 7:
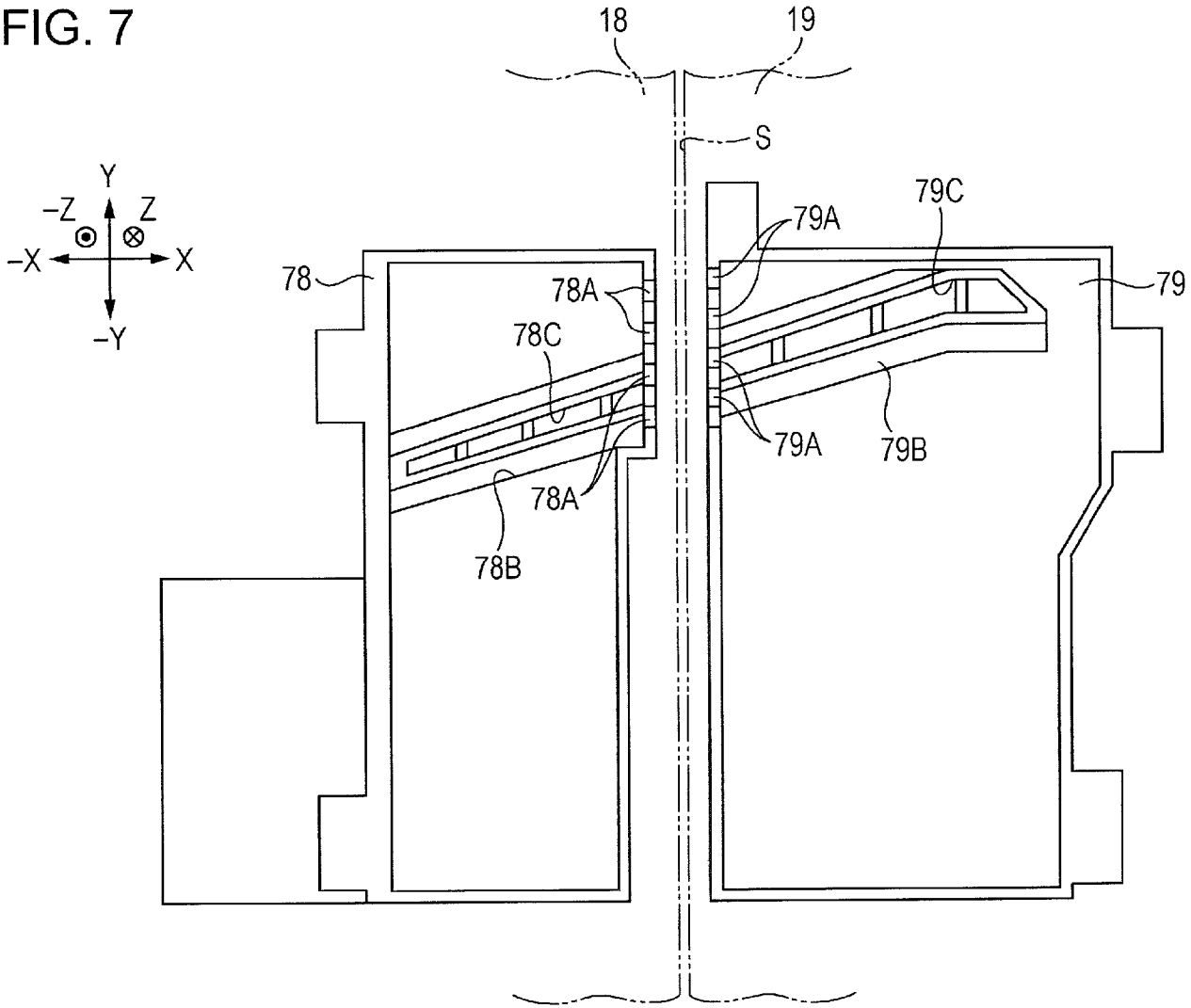
FIG. 7 is a front view illustrating the configurations of ducts according to the exemplary embodiment that take in the outside air.

As illustrated in FIG. 6, supply ports 73 and 74 through which the outside air is supplied are formed in the first flow path 71 and the second flow path 72 on the −Z direction side, respectively. As illustrated in FIG. 5 and FIG. 6, ducts 78 and 79 through which the outside air is taken in are disposed adjacent to the supply ports 73 and 74 in the −Z direction, respectively. As illustrated in FIG. 5 and FIG. 7, the ducts 78 and 79 are mounted on front covers 18 and 19, which are mounted on the image forming apparatus body 11 and which serve as opening/closing parts, respectively. The front covers 18 and 19 are arranged in such a manner as to open like a double door integrally with the ducts 78 and 79.

The duct 78 includes an intake port 78A, a passage 78B, and a discharge port 78C. The duct 79 includes an intake port 79A, a passage 79B, and a discharge port 79C. The intake ports 78A and 79A take in the outside air that has flowed in the image forming apparatus body 11 from a gap S between the front cover 18 and the front cover 19. The outside air, which has been taken in through the intake ports 78A and 79A, passes through the passages 78B and 79B. The discharge ports 78C and 79C eject the outside air, which has passed through the passages 78B and 79B, to a supply port 73 of the first flow path 71 and a supply port 74 of the second flow path 72.

In a state where the front covers 18 and 19 are closed, an edge of the discharge port 78C and an edge of the supply port 73 of the first flow path 71 are in contact with each other in such a manner as to communicate with each other, and an edge of the discharge port 79C and an edge of the supply port 74 of the second flow path 72 are in contact with each other in such a manner as to communicate with each other. Elastic members may be disposed at the edges in order to improve the degree of contact between the edges. Note that when the front covers 18 and 19 are open, the ducts 78 and 79 integrally move with the front covers 18 and 19, respectively, so that the edges are separated from one another.

In addition, as illustrated in FIG. 6, discharge ports 75 and 76 from which air is to be discharged are formed in the first flow path 71 and the second flow path 72 on the Z direction side, respectively. A duct 115 into which the air, which has been discharged from the discharge ports 75 and 76, flow is disposed adjacent to the discharge ports 75 and 76 in the Z direction. The duct 115 is mounted on a wall portion 17 (a rear frame) that faces in the Z direction and that is mounted on the image forming apparatus body 11. An end of the duct 115 on the −Z direction side is in communication with the discharge ports 75 and 76, and an end of the duct 115 on the Z direction side is in communication with a discharge port 15 that is formed in the wall portion 17. A fan 116 serving as an air-blowing unit (an air-exhaust unit) is disposed in the duct 115. The fan 116 is configured to blow air, which is inside the duct 115, in the Z direction by being driven. With this configuration, the air inside the duct 78, the duct 79, the first flow path 71, and the second flow path 72 is drawn in, and as indicated by arrows, the outside air that has been taken in from the ducts 78 and 79 and the hot air from the fixing unit 62 circulate. Note that, for example, a sirocco fan, an axial fan, or the like is used as the fan 116.

As described above, the first flow path 71 is formed in such a manner as to serve as a flow path that causes the hot air from the fixing unit 62 to circulate together with the outside air. The second flow path 72 is formed in such a manner as that the hot air, which has flowed in from the inlet ports 93A, 95A, and 95D, will not circulate in the second flow path 72 and that the outside air circulates in the second flow path 72. In other words, the second flow path 72 is formed in such a manner as to serve as a flow path in which air having a temperature lower than that of the air that circulates in the first flow path 71 circulates.

Figure 8:
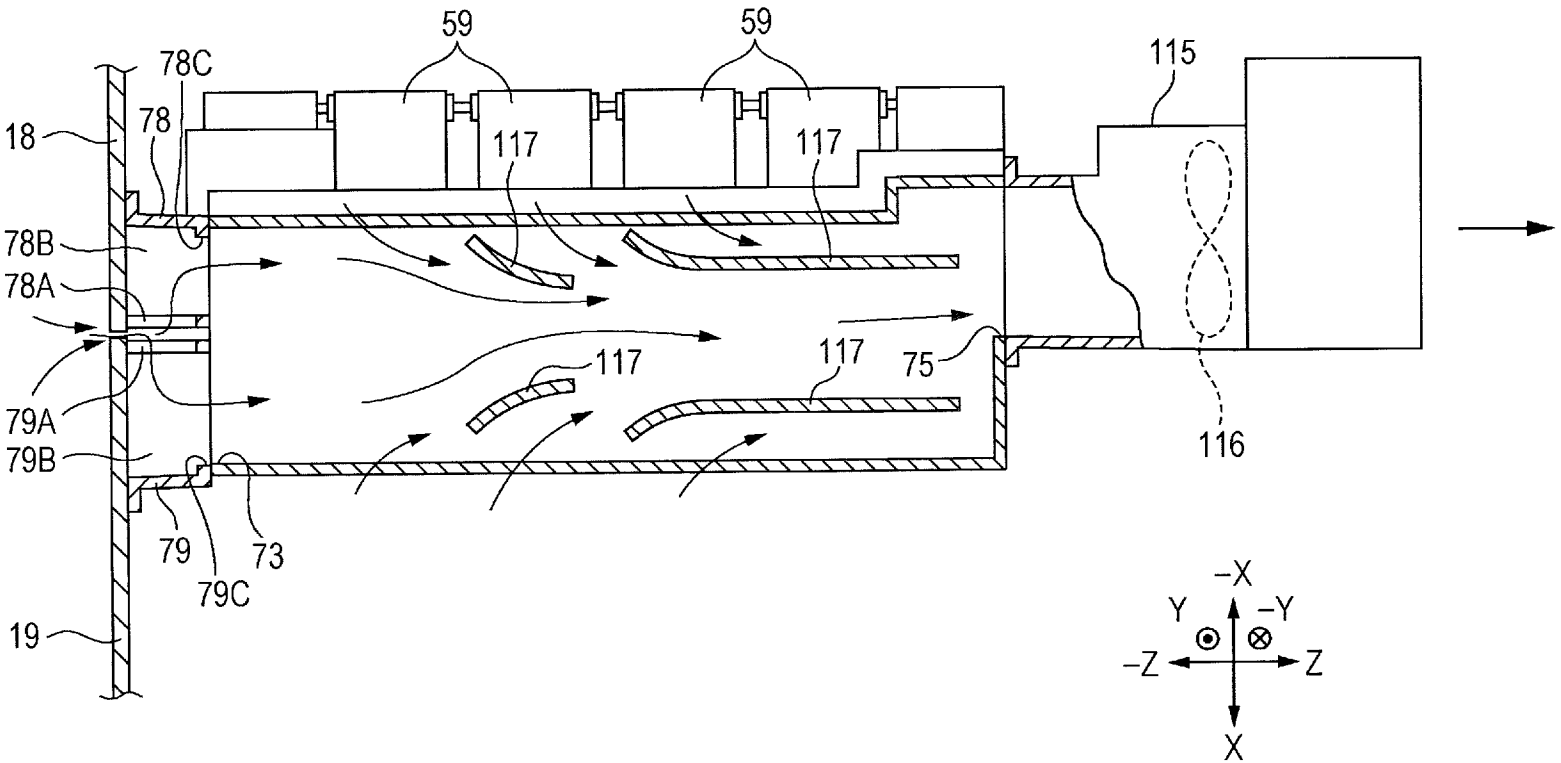
FIG. 8 is a plan sectional view illustrating the configuration of one of the flow paths according to the exemplary embodiment.

Note that, as illustrated in FIG. 8, rectifying plates 117 are disposed in the first flow path 71 in order to cause the hot air, which has flowed in from the inlet ports 93A, 95A, and 95D, to efficiently circulate in the Z direction.

Figure 9:
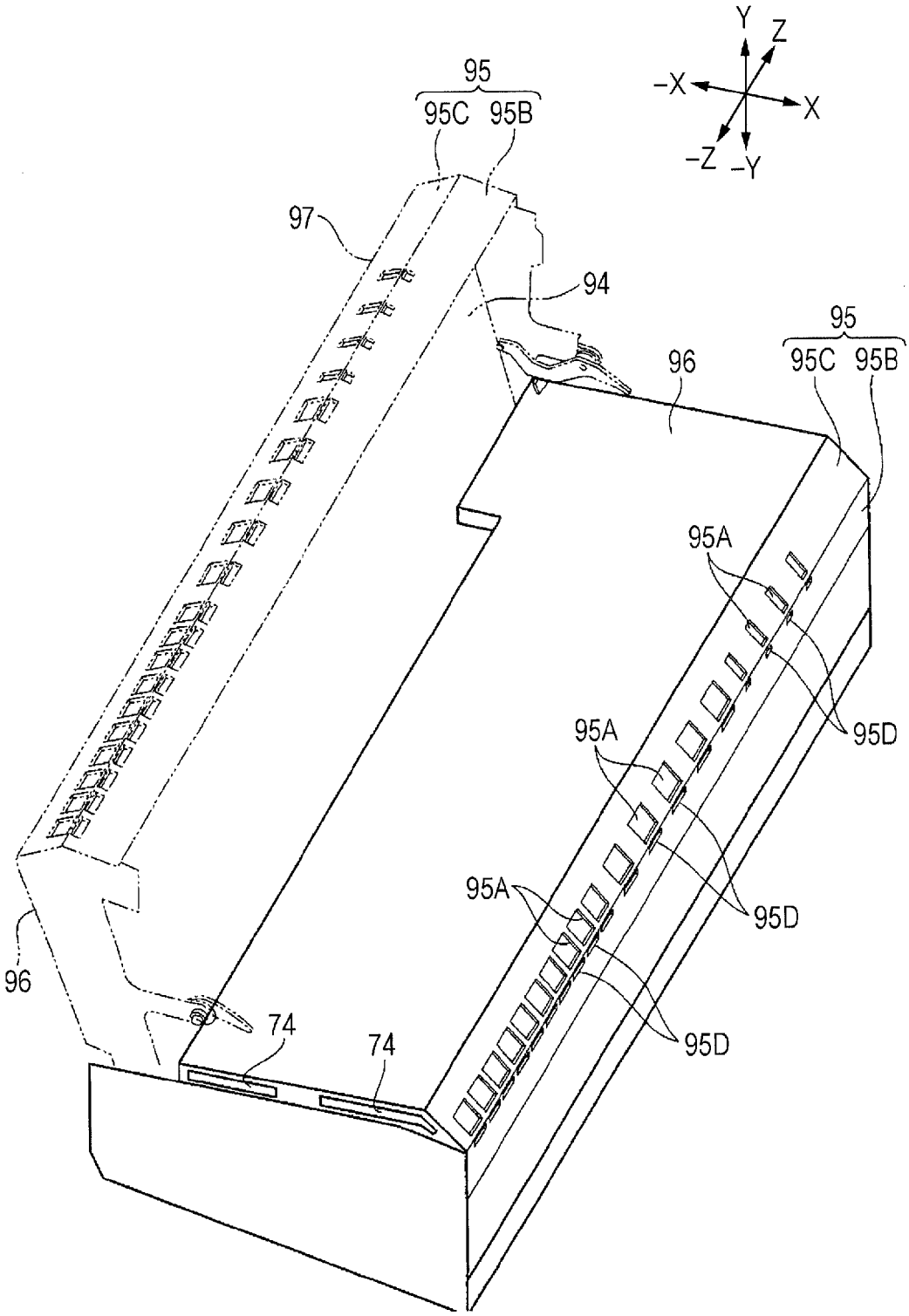
FIG. 9 is a perspective view illustrating an opening/closing cover of the fixing device according to the exemplary embodiment.

As illustrated in FIG. 9, the upper housing 90 of the fixing device 60 includes an opening/closing cover 97 (an example of an opening/closing portion) that includes the top wall 94, the outer wall 96 (an example of a wall portion), the first connecting wall 93, the second connecting wall 95, and the partition wall 98. The interior of the fixing device 60 in which the fixing unit 62 (the fixing belt 64) is included is open (exposed) by opening the opening/closing cover 97. With this configuration, maintenance and inspection for the fixing device 60, component replacement, removal of one of the recording media P that has become jammed in the fixing device 60, and the like are performed.

(Effects of Exemplary Embodiment)

Effects of the exemplary embodiment will now be described.

In the exemplary embodiment, the fixing belt 64 is heated by the first heating roller 69, the second heating roller 67, and the pad member 68. As illustrated in FIG. 5 and FIG. 6, the hot air that is discharged from the fixing belt 64, which has been heated, flows into the first flow path 71 via the inlet ports 93A, the inlet ports 95A, and the inlet ports 95D (see FIG. 3) by driving the fan 116 (see FIG. 6).

On the other hand, the outside air that has flowed in the image forming apparatus body 11 from the gap S between the front cover 18 and the front cover 19 is supplied to the supply port 73 of the first flow path 71 and the supply port 74 of the second flow path 72 via the ducts 78 and 79.

The hot air from the fixing belt 64 and the outside air mix with each other and circulate in the first flow path 71. On the other hand, the hot air, which is flowed in from the inlet ports 93A, 95A, and 95D, will not circulate in the second flow path 72, and the outside air circulates in the second flow path 72. Therefore, air having a temperature lower than that of the air that circulates in the first flow path 71 circulates in the second flow path 72.

Then, the hot air and the outside air, which have circulated in the first flow path 71, and the outside air, which has circulated in the second flow path 72, meet one another in the duct 115 and are discharged to outside the image forming apparatus body 11 from the discharge port 15 via the duct 115.

As described above, the hot air, which is discharged from the fixing belt 64, is discharged by being mixed with the outside air, so that an increase in the temperature of a component member around the periphery of the fixing device 60 is suppressed. In particular, as in the exemplary embodiment, in a configuration in which the intermediate transfer belt 24 is disposed adjacent to (above) the fixing device 60 in the Y direction, an increase in the temperature of the intermediate transfer belt 24 is effectively suppressed. Accordingly, in the intermediate transfer belt 24, occurrence of a phenomenon (a blocking phenomenon) in which the surface of a toner portion is melted and coagulated or fixed onto the component members in the image forming apparatus 10 is suppressed.

In addition, in the exemplary embodiment, the air having a temperature lower than that of the air that circulates in the first flow path 71 circulates in the second flow path 72, and thus, an increase in the temperature of the outer wall 96, that is, an increase in the temperature of an outer surface (a top surface) of the drawer member 100 (the fixing device 60) is suppressed.

Accordingly, when the drawer member 100 is drawn out from the image forming apparatus body 11, and an operation is performed on the drawer member 100, the time taken for the temperature of the outer surface (the top surface) of the drawer member 100 (the fixing device 60) to reach a predetermined temperature or lower is reduced. Note that "reducing the time", which has been described above, includes the case where no time is required for the temperature of the outer surface (the top surface) of the drawer member 100 (the fixing device 60) to reach a predetermined temperature or lower.

Accordingly, the efficiency of an operation that is to be performed on the drawer member 100 may be improved. Examples of the operation that is to be performed on the drawer member 100 are an operation of opening and closing the opening/closing cover 97, maintenance and inspection for the components of the fixing device 60, an operation of replacing the components, and an operation of removing one of the recording media P that has become jammed in the fixing device 60.

(Modifications)

In the exemplary embodiment, the second flow path 72 is formed adjacent to (above) the first flow path 71 in the Y direction. However, the exemplary embodiment is not limited to this, and for example, in the case where the first flow path 71 is formed adjacent to the fixing belt 64 in the X direction (the −X direction), the second flow path 72 is formed adjacent to the first flow path 71 in the X direction (the −X direction). In other words, the second flow path 72 may be formed adjacent to the first flow path 71 on the side opposite to that on which the fixing unit 62 is disposed.

In addition, although the flow paths are formed of the first flow path 71 and the second flow path 72 in the exemplary embodiment, the exemplary embodiment is not limited to this, and three or more flow paths may be formed. More specifically, for example, there is an aspect in which a partition part that partitions the second flow path 72 into upper and lower layers is provided in such a manner that the second flow path 72 becomes two flow paths.

Although the outside air, which has been taken in from outside the image forming apparatus body 11, circulates in the second flow path 72, the air inside the image forming apparatus body 11 may be taken into the second flow path 72. In this configuration, for example, air having a temperature lower than that of the air that circulates in the first flow path 71 circulates in the second flow path 72 by taking in the air inside the image forming apparatus body 11 at a position that is spaced apart from the fixing unit 62.

In addition, in the exemplary embodiment, the drawer member 100 is configured so as to be capable of being drawn out from the image forming apparatus body 11 without being separated from the image forming apparatus body 11. However, the drawer member 100 may be configured so as to be capable of being separated from the image forming apparatus body 11. In other words, the drawer member 100 may be configured so as to be capable of being removed from the image forming apparatus body 11.

The exemplary embodiment of the present invention is not limited to the above, and various modifications, changes, and improvement may be made. For example, plural modifications among the above-described modifications may be combined and employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drawer member that is capable of being drawn out from an image forming apparatus body, the drawer member comprising:

a fixing unit that heats and fixes an image onto a recording medium;

a first flow path that is formed around the fixing unit and that causes air that is heated by heat, which is discharged from the fixing unit, to circulate;

a second flow path that is formed adjacent to the first flow path on a side opposite to the fixing unit and in which air having a temperature lower than a temperature of air, which circulates in the first flow path, circulates; and an opening/closing portion that includes a wall portion and that is capable of causing the fixing unit to be open or closed, the wall portion being positioned adjacent to the second flow path on a side opposite to a side on which the first flow path is disposed and forming part of the second flow path.

2. An image forming apparatus comprising:

an image forming apparatus body;

an image forming unit that is disposed in the image forming apparatus body and that forms an image on a recording medium; and drawer member according to claim 1, which is capable of being drawn out from the image forming apparatus body and which includes the fixing unit that fixes an image onto the recording medium.

* * * * *